United States Patent [19]

Simmons

[11] 4,418,558

[45] Dec. 6, 1983

[54] METHOD OF MANUFACTURE OF VENTILATED SHEET METAL FLOOR MEMBERS

[75] Inventor: Robert A. Simmons, Deerfield, Ill.

[73] Assignee: Bantam Systems, Inc., Chicago, Ill.

[21] Appl. No.: 287,291

[22] Filed: Jul. 27, 1981

[51] Int. Cl.[3] ..... B21D 35/00

[52] U.S. Cl. ..... 72/177; 72/186; 72/187; 72/196; 52/303

[58] Field of Search ..... 72/177, 185, 186, 187, 72/196; 27/6.1, 163.5 R; 52/303

[56] References Cited

U.S. PATENT DOCUMENTS

| | | | |
|---|---|---|---|
| 547,952 | 10/1895 | Hayes | 29/6.1 |
| 2,313,533 | 3/1943 | Gersman | 29/6.1 |
| 2,818,009 | 12/1957 | Steffen | 52/303 |
| 3,293,725 | 12/1966 | Gunter et al. | 29/6.1 |
| 3,842,647 | 10/1974 | Knudson | 72/177 |
| 3,861,009 | 1/1975 | Baxter | 29/6.1 |
| 4,068,366 | 1/1978 | Hillesheim | 29/163.5 R |

*Primary Examiner*—Lowell A. Larson

*Attorney, Agent, or Firm*—Kinzer, Plyer, Dorn & McEachran

[57] ABSTRACT

Multi-aperture ventilated floor members, for use in a grain bin or like applications, are formed from continuous sheet metal strip stock, complete, in one pass through a cold roll forming machine, in a method in which the critical steps comprise roll-lancing the metal strip to form multiple closed slits transversely of the length of the strip and then roll corrugating the strip transversely of its length to widen the slits into narrow open ventilation slots by stretching the metal, simultaneously ironing out the projections formed when the slits are lanced into the strip.

3 Claims, 6 Drawing Figures

METHOD OF MANUFACTURE OF VENTILATED SHEET METAL FLOOR MEMBERS

BACKGROUND OF THE INVENTION

Sheet metal grain storage bins are used for both short-term and long-term storage of a wide variety of different grains. A grain storage bin of this type ordinarily includes a sheet metal housing, an elevated perforate sheet metal floor, and a fan for blowing air into the space below the floor so that the air flows upwardly through the floor and into the grain. The floor is made up of a plurality of elongated perforated floor members of generally channel-like cross-sectional configuration which interlock with each other to form a continuous floor. The floor may be supported on a variety of different kinds of support members; usually, the support members are freestanding sheet metal support legs. Examples of grain bin flooring systems of this general kind are disclosed in Kennedy U.S. Pat. No. 4,073,110 issued Feb. 14, 1978 and Trumper U.S. Pat. No. 4,137,682 issued Feb. 6, 1979.

The structural and operational characteristics of a grain bin floor can be relatively critical. To begin with, the floor must be quite strong, since the loading on the floor, when the grain storage bin is filled, may easily exceed one thousand pounds per square foot. Furthermore, the floor must support workers and their equipment during installation and cleaning. The perforations required in the floor, for passage of air, should be free of projections, since such projections can interfere with cleaning of the grain bin. Furthermore, any sharp projections on the top surface of the floor can present a severe problem to workers during installation of the floor, when it is frequently necessary to kneel on the floor while installing additional floor sections.

A grain bin floor construction previously manufactured and sold by Bantam Systems, Inc. of Chicago, Ill. and shown in that company's bulletin BS-2785 has afforded appreciable advantages as compared with the floor structures of the aforementiond Kennedy and Trumper patents. In the Bantam floor system, the individual floor members are arched transversely of the channel configuration and are also formed with a series of transverse corrugations, adding materially to the strength of the floor. The Bantam floor system employs multiple punched apertures for the ventilation openings, providing a high level of ventilation without sharp edges on the top of the floor that might interfere with cleaning or with installation. On the other hand, the multi-perforate construction used in the Bantam floor system is relatively costly, and the perforations weaken the floor somewhat due to the total amount of metal cut away, partially offsetting the improved strength characteristics provided by the arched and corrugated configuration of the floor members.

SUMMARY OF THE INVENTION

It is a principal object of the present invention, therefore, to provide a new and improved method of manufacture of sheet metal floor member for use in a grain storage bin or like application requiring passage of air or other fluid through the floor member, which method affords floor members of maximum strength, with no sharp projections at the ventilation apertures, at minimum cost.

A specific object of the invention is to provide a new and improved method of manufacture of sheet metal floor members for a grain storage bin that permits complete manufacture of the floor members from continuous strip stock in one pass through a multi-station roll forming machine.

Accordingly, the invention relates to a method of manufacture of sheet metal floor members for use in a grain storage bin or like application requiring passage of fluid through the floor member without permitting passage of granular material therethrough. The method comprises the following steps:

A. roll lancing a strip of sheet metal to form a series of short closed slits in the central portion of the strip with all of the slits extending in a common direction transverse to the length of the strip;

B. and subsequently roll forming the sheet metal strip to form a series of transverse corrugations in the central portion of the strip, so that the central portion of the strip is stretched longitudinally and the slits are thereby opened sufficiently to afford multiple narrow, open ventilation slots that allow free passage of fluid while precluding passage of granular material therethrough, simultaneously ironing out projections formed by the lancing of step A.

Steps A and B are performed sequentially in successive stages of a roll forming machine.

DESCRIPTION OF THE PREFERRED EMBODIMENT

Figure 1:
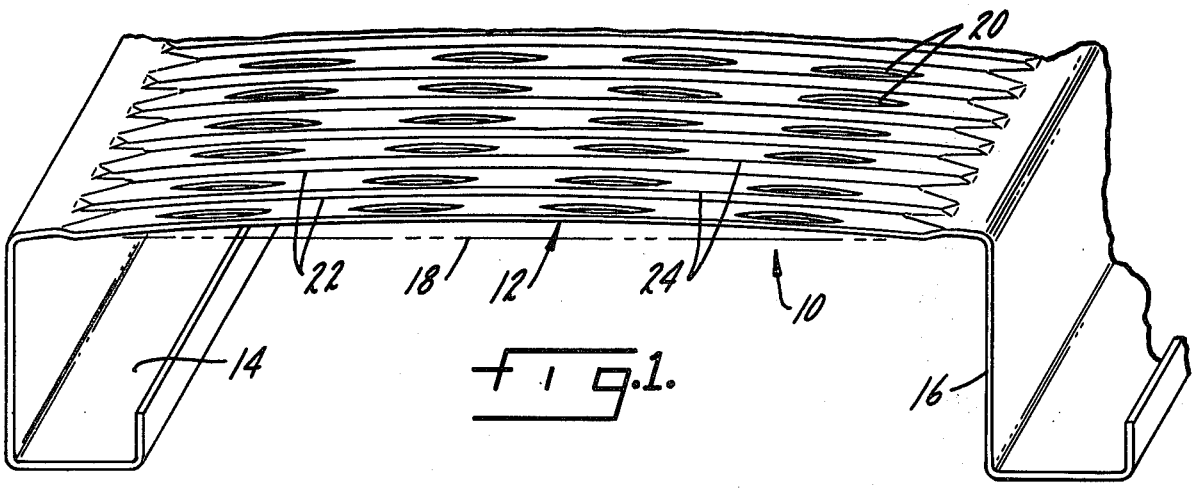
FIG. 1 is a perspective view of a segment of a typical floor member for use in a grain storage bin or like application manufactured in accordance with the method of the present invention.

FIG. 1 illustrates one end segment of a floor member 10 manufactured in accordance with the method of the present invention. Floor member 10, which may be of any desired length, includes a central floor surface portion 12 formed integrally with a depending male support channel 14 at one side of the floor member and a depending female support channel 16 at the opposite side of the floor member. When the floor is installed, the male support channel 14 of floor member 10 fits into the female support channel 16 of an adjacent similar floor member and both are engaged by a free standing sheet metal floor support (not shown) that maintains an air space or plenum below the floor. For typical support channel arrangements and floor supports, reference may be made to the Kennedy and Trumper patents and the Bantam bulletin identified above.

The central floor surface portion 12 of floor member 10 is of upwardly arched configuration, as indicated by the reference line 18, to strengthen the floor member, and includes a multiplicity of narrow ventilation slits 20.

This portion of floor member 10 is also formed in a series of transverse corrugations having peaks 22 and valleys 24; the corrugations extend parallel to the direction of the slots 20. In the preferred construction, as illustrated, the ventilation slots 20 are located intermediate the corrugation peaks 22 and valleys 24, but it is not essential that this alignment be preserved throughout floor member 10.

Floor member 10 is formed of sheet metal, usually galvanized sheet steel. Typically, the stock from which floor member 10 is fabricated comprises galvanized sheet steel having a thickness of approximately 0.038 to 0.039 inch. This material is strong enough for most grain bin applications; of course, a heavier or lighter sheet metal stock may be employed, depending upon end use requirements.

Figure 2:
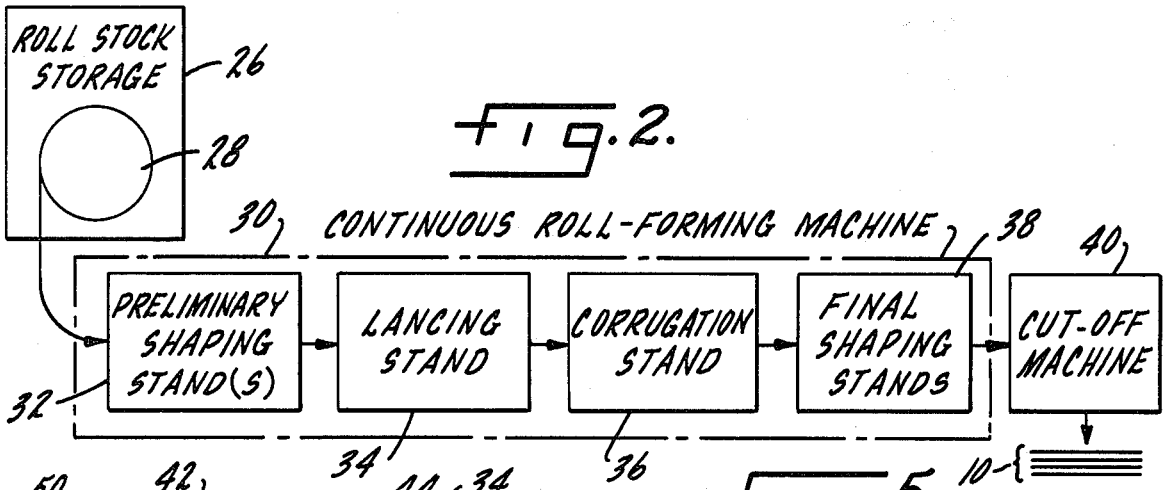
FIG. 2 is a schematic block diagram illustrating a roll forming machine in which the basic steps of manufacture required for the method of the invention are performed.

In the method of manufacture of floor member 10, according to the present invention, the complete fabrication of the floor member is carried out in a continuous roll forming machine 30 as generally illustrated in FIG. 2. As shown therein, flat sheet metal stock is fed from a roll 28 in a roll stock storage station 26 into the preliminary metal shaping stands 32 of roll forming machine 30. These preliminary shaping stands 32 may be employed, for example, for initial or even final shaping of the support channels 14 and 16 along the edges of the sheet metal strip 28.

Figure 3:
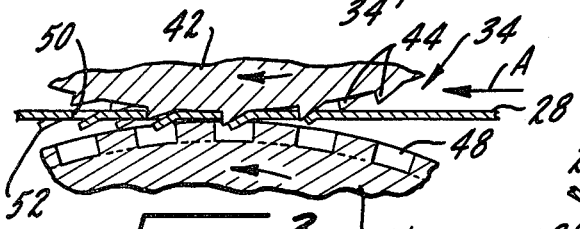
FIG. 3 illustrates a sheet metal lancing step employed in the method of the invention.

Strip 28, as it emerges from the preliminary shaping stands 32, retains a flat central portion that will ultimately form the floor surface portion 12 of a completed floor member 10 (FIG. 1). In this condition, the sheet metal strip 28 is fed into a lancing stand 34 (FIGS. 2 and 3). Lancing stand 34 initiates the formation of the ventilation slits 20, as described more fully below. From lancing stand 34, the sheet metal strip advances to a corrugation stand 36 (FIGS. 2 and 5) in which the corrugations 22, 24 are formed and formation of slots 20 is completed. After lancing and corrugation in stands 34 and 36 of roll forming machine 30, the sheet metal strip passes through one or more final shaping stands 38. In stands 38 the transverse arch configuration for the completed floor members is formed and the formation of channels 14 and 16 (FIG. 1) is completed. As the completely formed floor member strip emerges from machine 30, a cut-off machine 40 severs desired lengths, constituting the individual floor members 10.

The lancing stand 34 of the continuous roll forming machine 30 is somewhat schematically illustrated in FIG. 3. It includes an upper lancing roll 42 having a multiplicity of lancing teeth 44 projecting outwardly thereof. Stand 34 also comprises a lower lancing roll 46 incorporating a multiplicity of pockets 48, the pockets 48 being in registry with the individual lancing teeth 44. Typically, rolls 42 and 46 may each have a diameter of eight to ten inches; smaller rolls have been shown to save space in the drawing.

Figure 4:
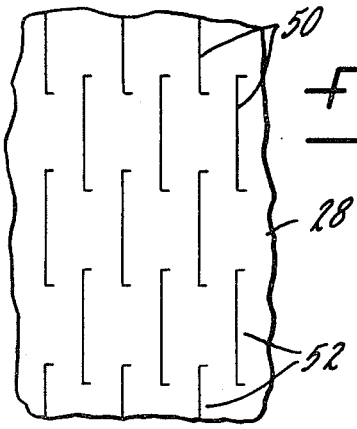
FIG. 4 is a detail plan view of the sheet metal stock emerging from the step of manufacture illustrated in FIG. 3.

The sheet metal strip 28, which is still flat in its central portion as noted above, advances through the roll-lancing stand 34 in the direction of the arrow A. As the sheet metal strip proceeds through the lancing station, each of the lancing teeth 44 engages the sheet metal and cuts a slit 50. Each slit 50 bounds one edge of a downwardly deflected lip or projection 52. The appearance of the metal strip 28, with its multiplicity of slits 50 and downwardly projecting lips 52, is shown in cross section in FIG. 3 and in plan in FIG. 4.

Figure 5:
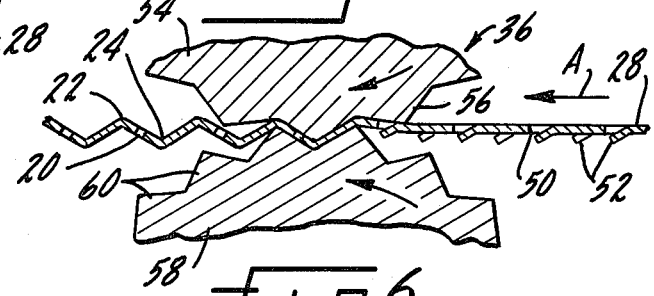
FIG. 5 illustrates a subsequent corrugation step in the method of the present invention.

The next step of the method is performed in corrugation stand 36 and is illustrated in FIG. 5. Corrugation stand 36 comprises an upper corrugation roll 54 having a series of transversely extending corrugation teeth 56 and a mating lower corrugation roll 58 with a series of projecting transverse corrugation teeth 60 that mesh with the teeth 56 of the upper roll. Again, the rolls may typically have diameters of about eight to ten inches.

Figure 6:
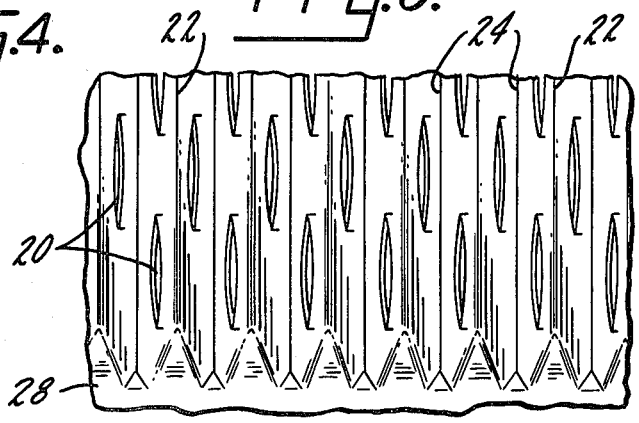
FIG. 6 is a detail plan view of the sheet metal following the manufacturing step of FIG. 5

As the metal strip 28, already lanced to form the slits 50, advances through the corrugation stand in the direction of arrow A, the meshing corrugation teeth 56 and 60 stretch the metal and shape it to form the corrugation peaks 22 and valleys 24. As the corrugations are formed, strip 28 is stretched in the direction or arrow A, normal to the direction of slits 50, so that the previously closed slits 50 are opened to form the ventilation slots 20. The width of opening of slots 20 can be adjusted by varying the corrugation height. At the same time, the stretching and forming operation performed by corrugation teeth 56 and 60 effectively "irons" the sheet metal to eliminate the sharp projecting lips 52. Thus, the central floor surface portion of the metal strip (FIGS. 5 and 6) incorporates a multiplicity of narrow, open slots 20 for ventilation purposes but has no sharp projections that would interfere with insulation of the floor or cleaning.

From the foregoing description, it will be seen that the method of the present invention includes the following critical steps, performed sequentially in successive stages of the roll forming machine 30:

A. roll lancing a strip of sheet metal strip 28 to form a series of short closed slits 50 in the central portion of the strip with all of the slits extending in a common direction, transverse to the length of strip 28;

B. and subsequently roll forming the sheet metal strip 28 to form a series of corrugations 22,24 in the central portion of the strip, the corrugations extending parallel to the direction of the slits 50 so that the central portion of the strip is stretched in a direction normal to the direction of the slits and the slits are thereby opened sufficiently to afford multiple narrow, open ventilation slots 20 that allow free passage of fluid while precluding passage of granular material therethrough, this corrugation step B simultaneously ironing out the projections 52 formed by the lancing step A.

It is not essential that any shaping of the metal strip 28 be performed prior to lancing stand 34 (FIG. 2). The lancing stand can be located at the inlet end of roll forming machine 30. Moreover, it is not critical to have corrugation stand 36 located immediately following lancing stand 34; one or more shaping stands for performing other operations on the metal strip can be interposed between lancing stand 34 and corrugation stand 36. However, it is usually preferable to have the two ventilation aperture formation stands 34 and 36 close together in machine 30, particularly when it is desired to maintain reasonably close registry between the ventilation slots 20 and corrugations 22,24. As previously noted, the arch in the central portion 12 of the metal strip 28 that is shaped into floor members 10 should be formed after both the lancing and the corrugation steps have been completed.

In some instances, it may be desirable to perform the corrugation step of the present invention in two successive stands in roll forming machine 30, depending upon the height of the corrugations and the resultant degree of stretching required of the sheet metal.

Floor members 10, as manufactured by the method of the present invention, are characteristically quite strong, relative to the thickness and strength of the sheet metal employed in fabrication, due to the combination of arched and corrugated construction employed for the central floor portions 12 of the floor members. Furthermore, since no sheet metal has been cut out of the central floor portion 12, the substantial reduction in strength that occurs with punch perforation is not encountered. At the same time, the cost of a perforating punch ahead of roll forming machine 30 is eliminated, so that the method of the invention results in a substantial economic benefit. Moreover, this is accomplished without the formation of sharp projections on the finished floor members. Preferably, the lancing and corrugation steps of roll forming stands 34 and 36 are correlated to locate the ventilation slots 20 on the corrugation slopes rather than on the peaks 22 or in the valleys 24.

I claim:

1. The method of manufacture of sheet metal floor members for use in a grain storage bin or like application requiring passage of fluid through the floor members without permitting passage of granular material therethrough, comprising the following steps:

A. roll lancing a strip of sheet metal to form a series of short closed slits in the central portion of the strip with the strip of sheet metal being fed into the rolls in the direction of its length and all of the slits extending in a common direction transverse to the length of the strip;

B. and subsequently roll forming the sheet metal strip to form a series of transverse corrugations in the central portion of the strip parallel to the slits, so that the central portion of the strip is stretched longitudinally and the slits are thereby opened sufficiently to afford multiple narrow, open ventilation slots that allow free passage of fluid while precluding passage of granular material therethrough, simultaneously ironing out projections formed by the lancing of step A;

steps A and B being performed sequentially in successive stages of a roll forming machine.

2. The method of manufacture of sheet metal grain bin floor members, according to claim 1, comprising the following additional step:

C. roll-forming the sheet metal strip to arch the strip upwardly in a direction transverse to the length of the strip, following step B.

3. The method of manufacture of sheet metal grain bin floor members, according to claim 1 or claim 2, in which the steps A and B are correlated to locate the ventilation slots on the slopes of the corrugations.

* * * * *